United States Patent [19]

Habu et al.

[11] 4,173,483

[45] Nov. 6, 1979

[54] SILVER HALIDE PHOTOGRAPHIC EMULSIONS FOR USE IN FLASH EXPOSURE

[75] Inventors: Teiji Habu; Tomio Nakajima; Eiichi Sakamoto; Noboru Fujimori; Kiyomitsu Mine, all of Hino, Japan

[73] Assignee: Konishiroku Photo Industry Co., Ltd., Nihonbashi-Muro, Japan

[21] Appl. No.: 690,042

[22] Filed: May 25, 1976

[30] Foreign Application Priority Data

May 27, 1975 [JP] Japan ..... 50-63672

[51] Int. Cl.[2] ..... G03C 1/08; G03C 1/14

[52] U.S. Cl. ..... 430/575; 430/1; 430/5; 430/945; 430/374; 430/603; 430/605; 430/550; 430/574; 430/576; 430/577

[58] Field of Search ..... 96/126, 124, 125, 108, 96/27 E

[56] References Cited

U.S. PATENT DOCUMENTS

| | | | |
|---|---|---|---|
| 2,977,229 | 3/1961 | Jones | 96/126 |
| 3,782,957 | 1/1974 | Ohkubo et al. | 96/125 |
| 3,790,390 | 2/1974 | Shiba et al. | 96/125 |
| 3,804,634 | 4/1974 | Shiba et al. | 96/125 |
| 3,915,715 | 10/1975 | Millikan et al. | 96/133 |
| 3,969,116 | 7/1976 | Shiba et al. | 96/126 |
| 3,982,950 | 9/1976 | Shiba et al. | 96/27 E |

*Primary Examiner*—Travis Brown

[57] ABSTRACT

A silver halide photographic material for use in flash exposure of less than 1/10000 second comprising $10^{-8}$ to $5\times10^{-7}$ moles/moles of silver halide of at least one compound belonging to Group VIII of the Periodic Table and at least one of the sensitizing dyes of the following formulas (I) or (II) and which is capable of sensitizing silver halide at less than 550 nm:

wherein R, $R_1$, $R_2$, $R_3$, Q, $X^{(-)}$, Z, $Z_1$, $Z_2$, n, $n_1$, $n_2$ and $n_3$ are as defined in the specification.

5 Claims, No Drawings

SILVER HALIDE PHOTOGRAPHIC EMULSIONS FOR USE IN FLASH EXPOSURE

This invention relates to spectrally sensitized silver halide photographic emulsions and particularly to silver halide photographic emulsions for use in flash exposure having an improved high spectral sensitivity to "flash exposure" within the wavelength zone of a bluish green light. The term "flash exposure" used herein will be defined later.

In recent years, there has rapidly been developed a new system technique for quick transmission of information. The new system technique utilizes a process in which such image information as photographs, letter or figure is visualized by effecting conversion of electric signals to light signals on a light-sensitive material. This new system technique has come to be utilized in such field of reprography as recording, simple plate making or reproduction. As major systems among them, there may be mentioned, for example, a press facsimile system in which an image information is electrically transmitted quickly to a remote place to display the same; a high speed photocomposing system for the quick reproduction of printing plates; a black-and-white film system according to a scanning process or a lith film system for dot forming machines according to the scanning process, or the recording of the computor output or a record reproduction technique for holography or, further, a photo-mask printing system adopted in an IC manufacturing process.

A light source used in an apparatus for such quick information transmission systems as mentioned above should be such that its intensity of illumination faithfully changes according to current change in electric signals. There are usually used such light sources as xenon electric flash, arc light, a high pressure mercury lamp, a xenon lamp, a flying spot by phosphor of a cathod-ray tube and, further, laser light. An apparatus for light sources is usually composed of a combination of these high illumination light sources and high speed shutters.

In general, the spectral energy distribution of the aforesaid light sources does not correspond to the spectral sensitivity distribution of silver halide photographic emulsions. For that reason, a spectral sensitization is strictly necessary to enhance the sensitivity of the silver halide photographic emulsions. Further, an exposure period of time, during which a light-sensitive material is exposed to light from the aforementioned light source, is usually $10^{-5}$ to $10^{-7}$ second, i.e. a short time less than 1/10,000 second. In the present specification, such that the short time exposure using the light sources of this kind as mentioned above, particularly a extremely short time exposure applied to a light-sensitive material from an inherent sensitivity zone of silver halide to a bluish green light zone of up to 550 nm, is called the "flash exposure".

In order to render a light-sensitive material containing silver halide highly sensitive to such flash exposure, it is preferable to spectrally sensitize the silver halide at the side of the long wavelength of the inherent sensitivity zone thereof, because such light sources, for example, as a xenon flash lamp and a carbon arc lamp have the spectral energy distribution of a relatively wide range. As phosphor of the cathod-ray tube, particularly those having short afterglow times, there may be mentioned, for example, "P-1", "P-11", "P-15", "P-16", "P-22D" and "P-24". Of the above-mentioned phosphors, luminescene maximum wavelength of "P-1" is at 525 nm, "P-15" at 505 nm, "P-22D" at 525 nm, and "P-24" at 520 nm, and it is preferable to sensitize the silver halide to these bluish green lights. Since "P-11" and "P-16" have their luminescence maximum wavelengths within the inherent sensitivity zone of silver halide, there is no need for spectral sensitization of the silver halide at the side of the longer wavelength thereof. However, it will become apparent from the following explanation that the present invention is effectively applicable to even such light sources.

Laser light as a light source used in the aforesaid quick information transmission systems is known to include various types of lasers, for example, such solid laser as of ruby or glass, such vapor laser as of helium, neon, argon, krypton, neon-helium or carbon dioxide gas, such liquid laser as using dye solutions, such semiconductor laser as using semiconductors and the like. Usable as lasers in the present invention, however, are those which emit a bluish green light, particularly preferred are helium-cadmium laser light, argon laser light and krypton laser light.

As stated previously, the flash exposure applicable to the present invention is such a short time exposure as less than 1/10,000 second under high intensity of illumination. In a silver halide photographic emulsion, there is observed a phenomenon of "reciprocity law failure", and in the case of an extremely short exposure time (less than $10^{-3}$ second), speed, gamma or density is lowered or reduced as compared with those in the case of normal exposure time ($10^{-2}$ second or thereabouts). Such phenomenon is influenced in many cases by the kind of silver halide photographic emulsion employed and the preparation technique, physical ripening and chemical ripening thereof and further by the kind of additives used, coupled with photosensitive characteristics of silver halide itself. Accordingly, in the case of light-sensitive materials for use in flash exposure, i.e. a short time exposure under high intensity of illumination, it is necessary to apply to the silver halide photographic emulsion used therein such spectral sensitization technique as capable of imparting excellent characteristics with respect to the short time exposure under high intensity of illumination to the emulsion.

It is well known to those skilled in the art that spectral sensitizers greatly vary in their spectral sensitization activity to silver halide photographic emulsions due to a slight difference in the chemical structure thereof. In the case of the present invention, as well, it is an unexpected fact that selected sensitizing dyes of a certain kind show extremely excellent spectral sensitivity to flash exposure in the co-presence of specific compounds.

Recently, there have been disclosed some spectral sensitization techniques in the technical field to which the present invention pertains. These spectral sensitization techniques known, however, deteriorate or lower, in most cases, high speed and high contrast photographic characteristics, which are important to a light-sensitive material for use in flash exposure, and also have such drawbacks that a high resolving power is lost and the acuteness of line drawing portions is found poor. Further, the sensitizing dyes of prior art are extremely low in sensitization stability under high humidity, for example, when photographic materials sensitized by such the sensitizing dyes, are stored at 80% relative humidity for about 2 days, the sensitization efficiency thereof is lowered to ½ or more of the original efficiency. Thus, the spectral sensitization techniques heretofore disclosed are not always practically satisfactory.

A first object of the present invention is to provide a silver halide photographic emulsion for use in flash exposure, which emulsion has an improved high spectral sensitivity to the flash exposure a wavelength range from the inherent sensitivity zone of silver halide to a bluish green light zone of up to 550 nm.

A second object of the present invention is to provide a silver halide photographic emulsion for use in flash exposure, which emulsions capable of giving a high resolving power for recording and reproducing high density information.

A third object of the present invention is to provide a silver halide photographic emulsion for use in flash exposure, which emulsion is capable of giving stabilized photographic characteristics on lith development and is suitable for a lith type film for use in a dot forming machine according to the afore-mentioned scanning process.

A fourth object of the present invention is to provide a silver halide photographic emulsion for use in flash exposure, which emulsion is highly sensitive to the flash exposure and is less in fog formation even when it is stored at high temperature and high humidity.

The above-mentioned objects and other objects of the present invention which will be detailed hereinafter are accomplished by incorporating at least one compound containing a metal belonging to Group 8 of the periodic table in an amount of $10^{-8}$–$5\times10^{-7}$ mole per mole of silver halide and at least one of the sensitizing dyes represented by the following general formula [I] or [II] into a silver halide photographic emulsion.

General formula (I)

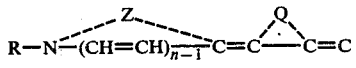

wherein R represents alkyl, substituted alkyl, or aryl; Z represents a non-metallic group necessary to complete a nitrogen-containing heterocyclic ring; Q represents a non-metallic group necessary to complete a rhodanin, thiohydantoin or thiooxazolidine-dione ring; and n represents an integer of 1 to 2.

General formula (II)

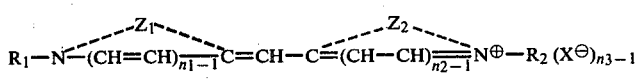

wherein $R_1$ and $R_2$ individually represent alkyl, substituted alkyl, or aryl; $Z_1$ and $Z_2$ individually represent a non-metallic group necessary to complete a pyridine, pyrrolin, oxazol, thiazole or selenazole ring; $X^{\ominus}$ represents an anion; and $n_1$, $n_2$ and $n_3$ individually represent an integer of 1 or 2, provided that $n_3$ is 1 when a sensitizing dye of the general formula forms an inner salt.

The compounds containing a metal belonging to Group 8 of the periodic table used in the present invention are those which contain such metals belonging to Group 8 of the periodic table as iron, cobalt, nickel, ruthenium, rhodium, palladium, osmium, iridium and platinum. As representatives of those compounds, there may be mentioned, for example, ferric chloride, potassium ferricyanide, cobalt chloride, luthioate, nickel chlroide, nickel sulfate, ruthenium chloride, ruthenium hydroxide, rhodium chloride, ammonium hexachlororhodate, palladium chloride, palladium nitrate, potassium hexachloroparadate, osmium chloride, iridium chloride ($IrCl_3$ and $IrCl_4$), potassium chloroiridate, ammonium hexachloroiridate, ammonium hexachloroplatinate and potassium hexachloroplatinate. These compounds may be incorporated, preferably in the form of an aqueous solution, in an amount of about $10^{-8}$ to $5\times10^{-7}$ mole per mole of silver halide, into a silver halide emulsion at the time of the silver halide particles formation or at the time of the physical ripening or chemical ripening thereof or thereafter. In case desensitization or a reversing phenomenon in images is apt to occur particularly due to the kind of metal in the compound, the process of preparing the emulsion or due to the development process therefor, the compound is preferably added in an amount of $10^{-8}$ to $10^{-7}$ mole per mole of silver halide prior to completion of the physical ripening.

In the sensitizing dyes of the aforesaid general formulas [I] and [II] used in the present invention, the nitrogen-containing heterocyclic ring containing Z in the general formula [I] is, for example, pyrrolin, thiazolin, thiazole, benzothiazole, naphthothiazole, selenazole, benzoselenazole, naphthoselenazole, oxazole, benzoxazole, naphthoxazole, imidazole, benzoimidazole, pyridine, quinoline and indole rings. Further, substituents may be introduced into the heterocyclic rings for Z, $Z_1$ and $Z_2$, said substituents including lower alkyl, lower alkoxy, aryl and halogen, and a benzene or naphthalene ring may be condensed to said nitrogen-containing rings. Into the benzene or naphthalene ring thus condensed may be introduced the above-mentioned substituents. The rhodanin, thiohydantoin or thiooxazolidinedione ring for Q may be substituted with such a group of groups as lower alkyl, lower alkoxy, sulfoalkyl, carboxyalkyl, hydroxyalkyl, allyl or aryl. Further, as typical examples of alkyl or the like represented by R, $R_1$ and $R_2$ in the aforesaid general formulas, there may be mentioned methyl, ethyl, propyl, butyl, β-sulfoethyl, γ-sulfopropyl, δ-sulfobutyl, γ-sulfobutyl, β-(γ-sulfopropoxy)ethyl, β-(δ-sulfothiobutoxy) ethyl, β-hydroxyethyl, β-hydroxy-γ-sulfopropyl, carboxymethyl, β-carboxyethyl, allyl, phenyl, p-chlorophenyl and p-carboxyphenyl.

As representatives of the anion for X, there may be mentioned, for example, commonly usable anions for forming cyanine dye salts such as a halogen ion, a perchlorate ion, a thiocyanic acid ion, a benzensulfonic acid ion, a p-toluenesulfonic acid ion and a methyl sulfate ion.

As representatives of the sensitizing dyes represented by the aforesaid general formulas [I] and [II], there may be mentioned, for example, such dyes as mentioned below.

(1)

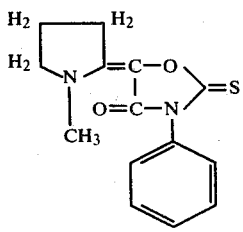

-continued
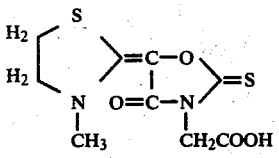
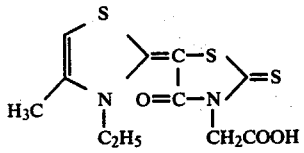
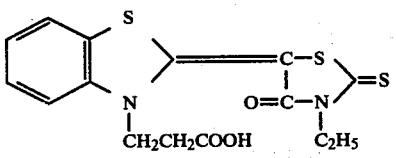
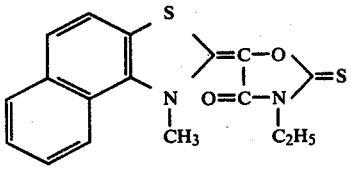
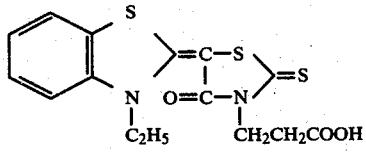
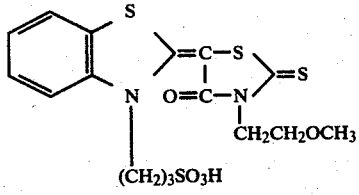
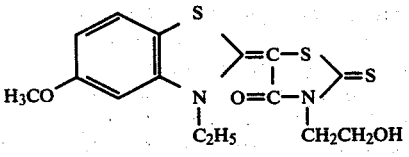
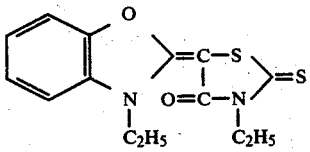
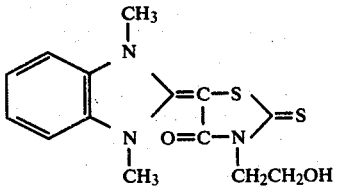
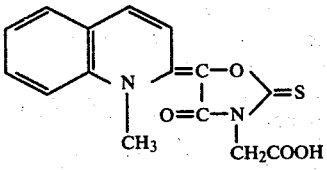
(2)
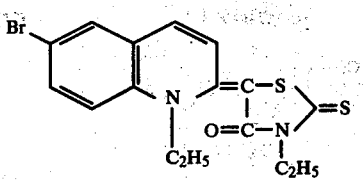
(3)
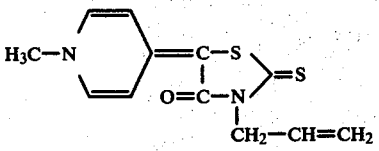
(4)
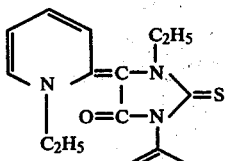
(5)
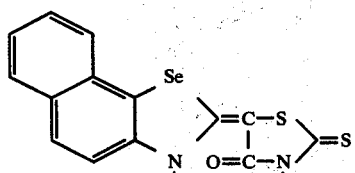
(6)
(7)
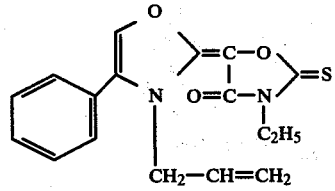
(8)
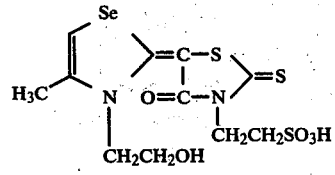
(9)
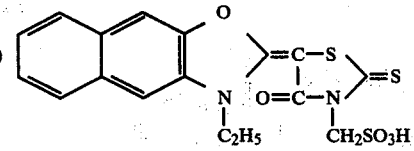
(10)
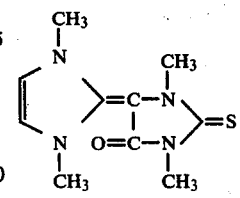
(11)
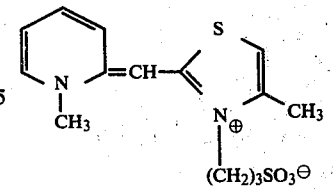
(12)
(13)
(14)
(15)
(16)
(17)
(18)
(19)
(20)

-continued (21)

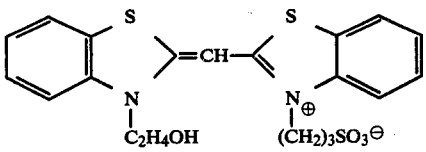

(22)

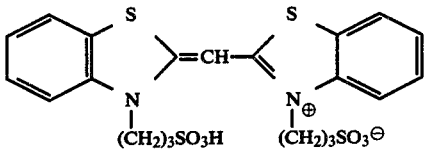

(23)

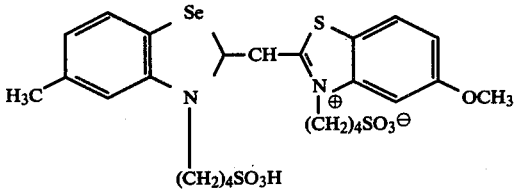

(24)

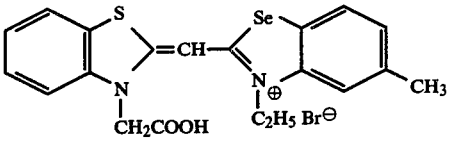

(25)

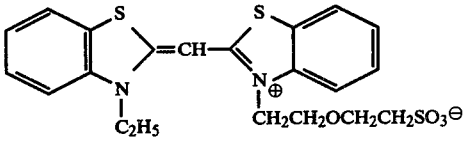

(26)

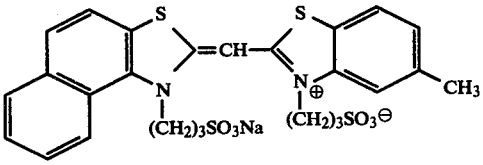

(27)

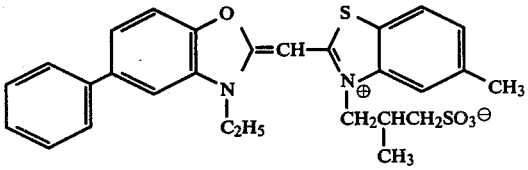

(28)

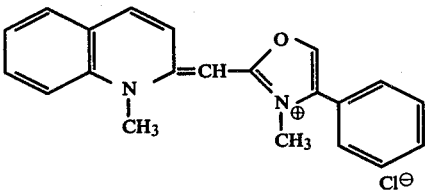

(29)

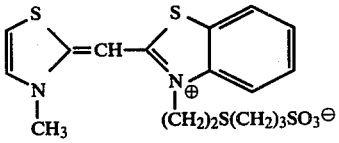

(30)

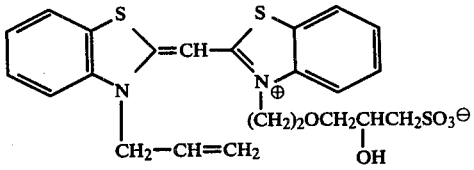

-continued (31)

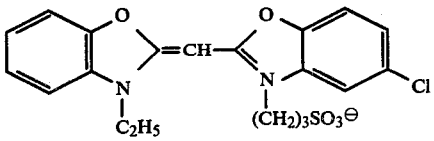

(32)

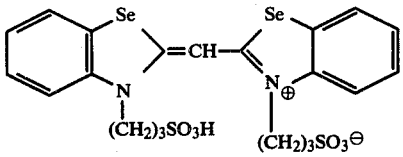

(33)

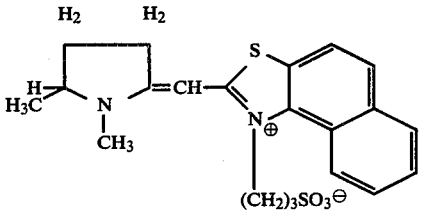

(34)

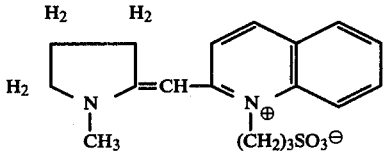

These sensitizing dyes are synthesized, for example, according to a process disclosed in F. M. Hermer, "The cyanine dyes and related compounds," 1964, Inter-Science Publishers and processes disclosed in British Pat. No. 660408, U.S. Pat. Nos. 2,161,331, 2,185,182 and 3,149,105 and Japanese Patent Publication No. 3644/1970.

In the present invention, the sensitizing dye represented by the aforesaid general formulas [I] and [II] may be incorporated into a silver halide emulsion, for example, by dissolving the dye in such solvent as methanol, ethanol, dimethyl sulfoxide or an aqueous alkali solution, either singly or in the form of solvent mixtures thereof, and then adding the dissolved dye at any time to the emulsion. Usually, however, the dye may be incorporated into the emulsion at any time after completion of the ripening and just before coating. The amount of sensitizing dye to be added may vary depending on the kind of a dye or dyes employed or on the kind of an emulsion. Usually, however, the dye may be used within a wide range from 3 to 500 mg per mole of the silver halide, and the optimum amount may be suitably selected at which the appropriate effect is obtained.

As silver halide used in a silver halide photographic emulsion for use in flash exposure according to the present invention, there may be such silver halide commonly used in silver halide photographic emulsions as silver bromide, silver chloride, silver iodobromide, silver chlorobromide and silver chloroiodobromide. However, a marked effect is obtained when silver halide containing silver chloride is used. Furthermore, although the particle diameter of the silver halide used is not particularly limited, the silver halide of 3μ or less in diameter is preferred, and particularly a marked effect is obtained when the particle diameter is below 1μ.

Hydrophilic colloid advantageously usable in the preparation of the silver halide photographic emulsion according to the present invention includes, besides gelatin which is commonly used in an ordinary silver halide photographic emulsion, such gelatin derivatives as acetylated gelatin, phthalated gelatin and the like, colloidal albumin, agar-agar, gum arabic, alginic acid, casein, water-soluble cellulose derivatives, polyvinyl alcohol, polyvinyl pyrrolidone and copolymers comprising such monomer components as vinyl alcohol, vinyl cyanoacetate, vinyl pyrrolidone, acrylic acid, methyl arcylate and vinyl imidazole.

The emulsion according to the present invention may be subjected, for example, to chemical sensitization by such noble metal sensitizers as potassium chloroaurate, auric trichloride, potassium auricthiocyanate, and 2-aurothiabenzothiazolemethyl chloride; such sulfur sensitizers as allylthiocarbamate, thiourea, allylisothiacyanate, sodium thiosulfate and cystein; such active or inert selenium sensitizers as potassium selenocyanate, selenourea and dimethylselenourea; a reduction sensitizer; polyalkylene sensitizers; or the like. Further, it is preferable to use development accelerators, for example, thioether type compounds, quarternary ammonium salts, polyalkylene oxide containing compounds and the like, and the preferred examples thereof are those disclosed in Japanese Patent Publication Nos. 13822/1968 and U.S. Pat. No. 3,625,697. The photographic emulsion according to the present invention may be stabilized by use of triazoles, imidazoles, azaindenes, benzothiazoles, mercaptans or cadmium containing compounds. The present emuslion may also contain wetting agents, plasticizers or agents for improving phsical properties of film, such dihydroxy alkanes as glycerine, pentadiol and the like, cyclohexanediols, acetylene alcohol, sethylenebisglycolate, bis-ethoxydiethylene glycol succinate or water-dispersible microparticulate high molecular compounds obtained by emulsion polymerization. The present emulsion may further contain various additives for a photographic emulsion, for example, such film hardening agents as aldehydes, ethylene imines, ketones, carboxylic acid derivatives, sulfonic acid esters, sulfonyl halide and vinylsulfone; such coating aids as saponin, sulfosuccinate and sodium dodecylbenzenesulfonate; such fluorescent whitening agents as bistriadinylaminostylbene type compounds; such super color sensitizing agents as nobolac type resin condensate of polyhydroxybenzene with formalin; antistatic agents; ultraviolet absorbing agents; dot improving agents; anti-fog agents; whitening agents; couplers to be incorporated into an emulsion; and toners.

In the present invention, other sensitizing dyes may advantageously be used in combination with the present sensitizing dyes represented by the aforesaid general formula [I] or [II]. The sensitizing dye preferably so usable in the present invention includes long-wavelength-light absorbing dyes set forth below as representatives. These sensitizing dyes, when used in combination with the sensitizing dye of the formula, do not hinder at all the present sensitizing dye from its action and effect and, on the contrary, such sensitizing dye may impart, to a photosensitive emulsion containing the latter, the desirable photographic characteristics against "reciprocity law failure" especially in the exposure by high intensity of illumination.

(I)

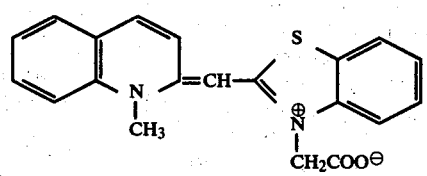

(II)

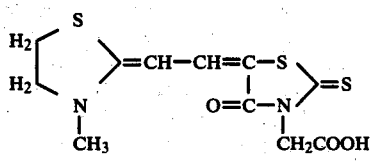

(III)

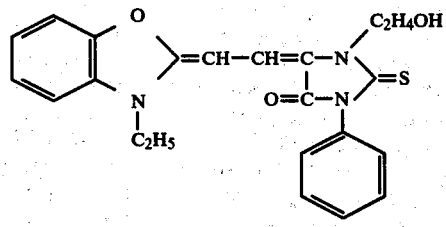

(IV)

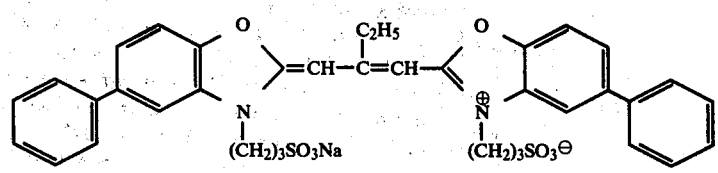

(V)

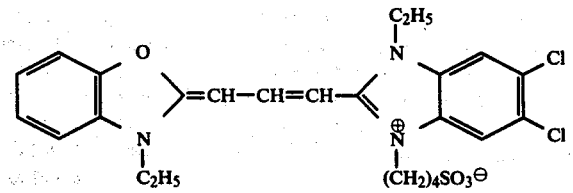

-continued

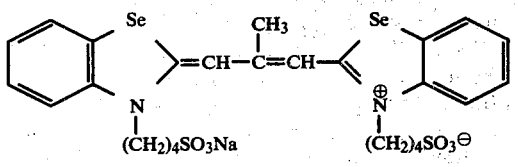

(VI)

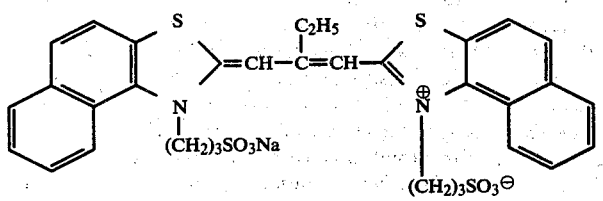

(VII)

In order to facilitate a handling, under darkroom light, of the silver halide photographic emulsion of the present invention, dyes disclosed, for example, in Japanese Laid-Open-to Public No. 10918/1973 may be incorporated into the present silver halide photographic emulsion.

The silver halide photographic emulsion according to the present invention is coated on a suitable support in order to be used for preparing a light-sensitive silver halide photographic material. Supports on which the silver halide photographic emulsion of the present invention is coated are, for example, any supports including such papers as baryta paper and polyethylene-coated paper, glass plates, cellulose acetate, cellulose nitrate of polystyrene films, such polyester films as polyethylene terephthalate films, polycarbonate films and polyamide films.

Light-sensitive photographic materials comprising the silver halide photographic emulsion of the present invention may be processed, as well as by an ordinary treatment method in which development and fixation are carried out, by a treatment method according to a diffusion transfer process or a so-called quick treatment method wherein a developer is previously incorporated into a light-sensitive photographic material.

As disclosed, for example, in U.S. Pat. No. 2,448,060 or Japanese Patent Publication No, 4935/1968, silver halide photographic emulsions, which contain the aforesaid compounds containing metals belonging the Group VIII of the periodic table but free of any sensitizing dyes represented by the aforesaid general formula [I] or [II], enhance their inherent sensitivity but are insufficient in sensitivity to a bluish green light zone with which the present invention deals. On the contrary, silver halide photographic emulsions, which contain sensitizing dyes of the aforesaid general formula [I] or [II], but do not contain such metal compounds as mentioned above, are also insufficient in sensitivity to a bluish green light zone. However, the silver halide photographic emulsions of the present invention, which simultaneously contain both components mentioned above, can markedly be enhanced sensitivity in flash exposure to a bluish green light zone. A mechanism which exhibits such desirable actions and effects has not been clarified yet. However, it is probably considered that inhibition of re-combination process due to hall trap is ascribable partly to such actions and effects.

The present invention is explained below in more detail with reference to examples, but it should be construed that the invention is not limited to those examples.

EXAMPLE 1

Using the liquids as formulated below, a silver halide emulsion was prepared according to the following operational procedure.

| | |
|---|---|
| Liquid I: | |
| Potassium bromide | 80 g |
| Potassium iodide | 1.5 g |
| Gelatin | 100 g |
| Water | 1000 ml |
| Liquid II: | |
| Silver nitrate | 100 g |
| Ammonia water | 105 ml |
| Water | 1000 ml |
| Liquid III: | |
| Gelatin | 130 g |
| Water | 200 ml |
| Liquid IV: | |
| Chlorauric acid (0.2% aqueous solution) | 16 ml |
| Ammonium thiocyanate (0.5% aqueous solution) | 25 ml |

Liquid I being stirred at 40° C. was charged with liquid II, and the resulting mixture was subjected to ripening at 40° C. for 10 minutes.

Separately, the same operation as above was repeated to obtain an emulsion containing potassium hexachloroiridate in an amount of $10^{-7}$ mole per mole of silver halide.

The thus prepared two emulsions were individually neutralized with an appropriate amount of acetic acid and then charged with liquid III. After cooling and coagulating, the coagulated emulsions were individually pulverized and then washed for 2 hours in flowing water. Subsequently, the thus finely divided emulsions were individually melted and then charged with liquid IV and then subjected to ripening at 50° C. for 90 minutes. These two emulsions were individually divided into two equal portions, only one of which was then incorporated with exemplified dye [13] in an amount of $5\times10^{-3}$ mole per mole of silver halide. Each of the 4 portions so divided was charged with saponin, mucochloric acid and 4-hydroxy-6-methyl-1,3,3*a*,7-tetrazaindene and ajusted with sodium carbonate to pH 6.5. Each then was coated on a cellulose triacetate film support and dried thereafter.

Using a xenon lamp, the samples of four kinds thus prepared were individually exposed to light for $10^{-2}$ second (exposure method 1) or for $10^{-6}$ second (exposure method 2). In performing the exposure methods 1 and 2, individually, an interference filter (transmission maximum wavelength: 500 nm) capable of transmitting a bluish green light was used in order to obtain a monochromatic light, and also a ND filter of a neutral gray was used to control exposure amount so that the same exposure amount may be attained in said exposure methods 1 and 2.

The exposed samples thus obtained were individually developed at 20° C. for 5 minutes with a developer having the following composition and thereafter fixed, water-washed and then dried.

| Composition of developer: | |
|---|---|
| Methol | 3 g |
| Anhydrous sodium sulfite | 50 g |
| Hydroquinone | 6 g |
| Sodium carbonate (monohydrate) | 29.5 g |
| Potassium bromide | 5 g |
| Water to make | 2,000 ml |

Subsequently, each developed sample was tested by use of an automatic densitometer (manufactured by Konishiroku Photo Industry Co., Ltd.) to obtain photographic characteristic curves and a speed in terms of the reciprocal of an exposure amount necessary to give an optical density of 0.5 above fog. The results obtained were as shown in the following Table 4. In the table, the speed was represented by a relative value measured by assuming as 100 the speed of sample No. 1 free of both the compound of a Group 8 metal and a dye and exposed according to the exposure method 1.

Table 1

| Sample No. | Compound of Group VIII metal added | Sensitizing dye added | Relative speed Exposure method 1 | Relative speed Exposure method 2 |
|---|---|---|---|---|
| 1 | — | — | 100 | 54 |
| 2 | Potassium hexa-chloroiridate | — | 36 | 29 |
| 3 | — | Dye 13 | 450 | 270 |
| 4 | Potassium hexa-chloroiridate | Dye 13 | 450 | 430 |

As is clear from Table 1, it is understood that sample No. 4 of the present invention which contains both the compound of the Group VIII metal and dye [13], as compared with the other samples, has a marked sensitization effect in flash exposure by bluish green zone light.

EXAMPLE 2

A silver chlorobromide emulsion (having an average particle diameter of 0.20μ, and containing 25 mol% of silver bromide) was prepared according to the usual method. At the time of forming silver halide particles, ammonium hexachloroiridate was added in various amounts, based on 1 mole of the silver halide, as indicated in the following Table 2. Thus, there were contained four kinds of emulsions. These emulsions were individually charged with chlorauric acid and sodium thiosulfate and then subjected to chemical ripening. These four emulsions were individually divided into two portions, one of which was incorporated with a solution of dye [23] in methanol, while the other with a solution of the undermentioned control dye in methanol, the amount of both dyes being $10^{-3}$ mole per mole of silver halide.

(Control dye)

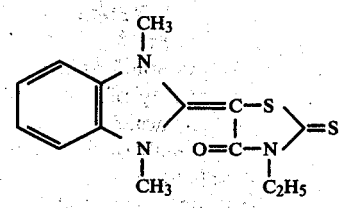

Subsequently, each divided portion was charged with polyethylene oxide having an average molecular weight of 4000, formalin, saponin and 4-hydroxy-6-methyl-1,3,3a,7-tetrazaindene to prepare 8 kinds of silver halide emulsions. These emulsions were individually coated on a subbed polyethylene terephthalate film support so as to form a layer having a dry thickness of 5μ and then dried to prepare samples.

The samples thus prepared were individually exposed to light in the same manner as in Example 1 and then developed at 20° C. for 2 minutes 10 seconds with a lith type developer (D-85 formulated by Eastman Kodak Co.). The developed samples were individually tested for speed according to the same procedure as in Example 1. The results obtained were as shown in Table 2. In the table, the speed was represented by a relative value measured by assuming as 100 the speed of sample No. 6 free of the compound of the Group VIII metal but charged with the control dye only and exposed according to the exposure method 1.

Table 2

| Sample No. | Amount of compound of Group VIII metal added (mole/mole of Agx) | Sensitizing dye added | Relative speed Exposure method 1 | Relative speed Exposure method 2 |
|---|---|---|---|---|
| 5 | — | Dye 23 | 105 | 32 |
| 6 | — | Control dye | 100 | 32 |
| 7 | $10^{-9}$ | Dye 23 | 115 | 32 |
| 8 | $10^{-9}$ | Control dye | 110 | 32 |
| 9 | $10^{-7}$ | Dye 23 | 115 | 120 |
| 10 | $10^{-7}$ | Control dye | 110 | 55 |
| 11 | $10^{-5}$ | Dye 23 | 27 | 23 |
| 12 | $10^{-5}$ | Control dye | 23 | 14 |

From Table 2, the following is understood. That is, if the amount of the compound of the Group VIII 8 metal added is less than $10^{-9}$ mole per mole of the silver halide, practically no effect of addition thereof is obtained. On the contrary, when the amount is greater than $10^{-5}$ mole, desensitization due to the compound of the Group VIII metal is exhibited, whereby a relative speed is lowered. It is also understood that dye [23] of the present invention shows a high sensitivity in flash exposure when used in combination with the compound of the Group VIII metal, whereas in the case of the control dye an improvement is observed in reciprocity failure especially as to high intesity of illumination even when used in combination with the compound of the Group VIII metal.

EXAMPLE 3

After exposure to light according to the exposure method 2, the samples obtained in Example 2 were individually developed with the same developer as in Example 2 by use of an automatic developing machine (G-17 type manufactured by Konishiroku Photo Industry Co., Ltd.). The developed samples were individually measured for a relative speed according to the same procedure as in Example 2 and, in addition thereto, the gamma and dot quality of line drawing portions were measured. It will be noted that the above development was repeated for each of the exposure times from 1 minute 20 seconds up to 2 minutes 20 seconds with an interval of 10 seconds with respect to each sample, and the measured values of the selected samples which were found smallest in fringe were taken up for each sample and shown as the determined values. Dot quality was measured by observing the acuteness of a dotted silver image through a microscope and evaluated according to the 5-gradation method by assuming as 5 the best quality and as 1 the poorest. The results obtained were as shown in the following Table 3. In the table, the speed was represented by a relative value measured by assuming as 100 the speed of sample No. 6.

Table 3

| Sample No. | Relative speed | Gamma | Dot quality |
|---|---|---|---|
| 5 | 110 | 10 | 3 |
| 6 | 100 | 9 | 3 |
| 7 | 100 | 10 | 4 |
| 8 | 100 | 10 | 3 |
| 9 | 590 | >12 | 5 |
| 10 | 280 | 10 | 3 |
| 11 | 78 | 8 | 3 |
| 12 | 67 | 8 | 3 |

As is clear from Table 3, it is understood that sample No. 9 of the present invention shows excellent photographic characteristics even when subjected to a quick lith development.

EXAMPLE 4

A silver iodobromide emulsion containing 3 mole% of silver iodide was prepared according to the usual method. At the time of formation of silver halide particles, the compounds of the Group VIII metals were individually added to the emulsion in the manner as shown in the following Table 4. The silver iodobromide emulsion thus prepared was subjected, according to the usual method, to gold-sulfur sensitization and then charged with each of the exemplified dyes in an amount of $10^{-4}$ mole per mole of silver halide individually in the manner as shown in the following Table 4. Subsequently, the emulsion thus treated was charged with formalin, seponin, phenylmercaptotetrazole and 4-hydroxy-6-methyl-1,3,3*a*,7-tetrazaindene. The resulting emulsion was coated on a subbed polyethylene terephthalate film support and then dried to obtain samples of 15 kinds.

The samples thus obtained were individually subjected to a $10^{-6}$ second flash exposure with a light source prepared by equipping a xenon lamp with an interference filter capable of transmitting a bluish green light and a neutral filter so that the light source resembles "P-11" phosphor of the cathode-ray tube in spectrum distribution.

The exposed samples thus obtained were individually developed at 20° C. for 5 minutes with D-19 developer (formulated by Eastman Kodak Co.), and the developed samples were individually measured for speed, graininess and resolving power. The results obtained were as shown in Table 4.

At to the measurement of graininess, when a sample is viewed directly or by projecting the images of the sample by enlargement, visible information contained in the sample sometimes appears as "storm" of grains of developed silver images or color forming dyes, and an amount of disliking this "storm" is psychologically grasped as graininess. The graininess was represented by the standard deviation of density as measured when a portion having an average optical density of 1.0 was scanned by means of a microdensitometer having an opening of 20μ in diameter. The resolving power was determined on the basis of a response function obtained according to Coltmann's method. The principle of this method is established on the fact that when a rectangular change in exposure amount is given to a light-sensitive material, change in density of image is identical with phase of change in exposure amount, but amplitude comes to change. That is; this amplitude comes to decay when frequency of change in exposure amount is high, and degree of this decay agrees practically with the concept of resolving power according to the conventional measurement method. In order to express quantitatively the degree of this decay, amplitude of an image density at the time of space frequency where change in exposure amount exists is formalized by amplitude of at the time of zero frequency (this formalized value is represented by gain%), and is represented by function of the space frequency. In this example, the resolving power was represented by a space frequency (line/mm) when amplitude of the image density was gain 20% and an average optical density was 0.7. The speed was represented by a relative value measured by assuming as 100 the speed of sample No. 13.

Table 4

| Sample No. | Compound of Group VIII metal added (per mole of Agx) | Sensitizing dye added | Relative speed | Graininess | Resolving power |
|---|---|---|---|---|---|
| 13 | — | — | 100 | 0.018 | 150 |
| 14 | Potassium ferricyanide ($10^{-7}$ mole) | — | 102 | 0.017 | 150 |
| 15 | — | Dye (6) | 96 | 0.016 | 155 |
| 16 | Potassium ferricyanide ($10^{-7}$ mole) | Dye (6) | 122 | 0.013 | 180 |
| 17 | Potassium chloroiridate ($10^{-7}$ mole) | — | 116 | 0.017 | 155 |
| 18 | — | Dye (7) | 101 | 0.017 | 155 |
| 19 | Potassium chloroiridate ($10^{-7}$ mole) | Dye (7) | 138 | 0.017 | 170 |
| 20 | — | Dye (27) | 102 | 0.018 | 160 |
| 21 | Potassium chloroiridate ($10^{-7}$ mole) | Dye (27) | 135 | 0.012 | 190 |
| 22 | — | Dye (33) | 104 | 0.016 | 160 |
| 23 | Potassium chloroiridate ($10^{-7}$ mole) | Dye (33) | 141 | 0.013 | 185 |
| 24 | Potassium chloroiridate ($10^{-7}$ mole)<br>Potassium chlororhodate ($10^{-8}$ mole) | — | 119 | 0.017 | 160 |
| 25 | Potassium chloroiridate ($10^{-7}$ mole)<br>Potassium chlororhodate ($10^{-8}$ mole) | Dye (7) | 140 | 0.012 | 190 |

Table 4-continued

| Sample No. | Compound of Group VIII metal added (per mole of Agx) | Sensitizing dye added | Relative speed | Graininess | Resolving power |
|---|---|---|---|---|---|
| | Potassium chloroiridate ($10^{-7}$ mole) | | | | |
| 26 | | Dye (27) | 135 | 0.010 | 195 |
| | Potassium chlororhodate ($10^{-8}$ mole) | | | | |
| | Potassium chloroiridate ($10^{-7}$ mole) | | | | |
| 27 | | Dye (33) | 142 | 0.013 | 200 |
| | Potassium chlororhodate ($10^{-8}$ | | | | |

As is clear from Table 4, it is understood that the samples of the present invention (Nos. 16, 19, 21, 23, 25 and 27) are excellent in relative speed, graininess and resolving power. When high speed contract photographing is effected using, in particular, a cathode-ray tube as a light source, a high resolving power of silver halide photographic emulsion is required. The present invention is capable of providing highly useful silver halide photographic emulsions meeting such requirement for this use.

The present invention is different in its technical idea from the prior art aiming at improvement in resolving power by use of anti-irradiation dyes, antihalation dyes or development inhibiting agents, or by pulverization of silver halide particles. The present invention is also excellent as a process for enhancing resolving power of silver halide photographic emulsion, which process may also be usable in combination with the prior art processes therefor.

What we claim is:

1. A silver halide photographic emulsion for use in flash exposure which comprises at least one compound containing a metal belong to Group VIII of the periodic table in an amount of $10^{-8}$ to $5\times10^{-7}$ mole per mole of silver halide and at least one of sensitizing dyes represented by the formula (I) or (II) and capable of sensitizing silver halide at less than 550 nm;

Formula (I)

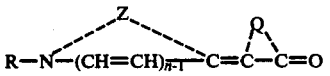

wherein R is selected from the group consisting of alkyl, allyl, aryl, substituted alkyl selected from the group consisting of β-sulfoethyl, γ-sulfopropyl, δ-sulfobutyl, γ-sulfobutyl, β-(γ-sulfopropoxy)ethyl, β-(δ-sulfothiobutoxy)ethyl, β-hydroxyethyl, β-hydroxy-γ-sulfopropyl, carboxymethyl and β-carboxyethyl, and substituted aryl selected from the group consisting of p-chlorophenyl and p-carboxyphenyl; Z represents a non-metallic group necessary to complete a nitrogen-containing heterocyclic ring selected from the group consisting of pyrroline, thiazoline, thiazole, benzothiazole, naphthothiazole, selenazole, benzoselenazole, naphthoselenazole, oxazole, benzoxazole, naphthoxazole, imidazole, benzoimidazole, pyridine, quinoline, and indole; Q represents a non-metallic group necessary to complete a rhodanine, thiohydantoin or thiooxazolidinedione ring which may be substituted by a group selected from the group consisting of lower alkyl, lower alkoxy, sulfoalkyl, carboxyalkyl, hydroxyalkyl, allyl and aryl; and n represents an integer of 1 or 2;

Formula (II)

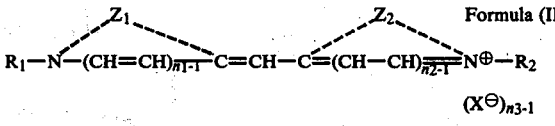

wherein $R_1$ and $R_2$ individually are selected from the group consisting of alkyl, allyl, aryl, substituted alkyl selected from the group consisting of β-sulfoethyl, γ-sulfopropyl, δ-sulfobutyl, γ-sulfobutyl, β-(γ-sulfopropoxy)ethyl, β-(δ-sulfothiobutoxy)ethyl, β-hydroxyethyl, β-hydroxy-γ-sulfopropyl, carboxymethyl and β-carboxyethyl, and substituted aryl being selected from the group consisting of p-chlorophenyl and p-carboxyphenyl; $Z_1$ and $Z_2$ individually represent a non-metallic group necessary to complete a pyridine, pyrroline, oxazole, thiazole or selenazole ring; $X^-$ represents an anion; and $n_1$, $n_2$ and $n_3$ individually represent an integer of 1 or 2; provided that $n_3$ is 1 when a sensitizing dye of the general formula forms an inner salt.

2. A silver halide photographic emulsion according to claim 1 wherein the compound containing the metal is selected from the group consisting of ferric chloride, potassium ferricyanide, cobalt chloride, luthioate, nickel chloride, nickel sulfate, ruthenium chloride, ruthenium hydroxide, rhodium chloride, ammonium hexachlororhodate, palladium chloride, palladium nitrate, potassium hexachloroparadate, osmium chloride, iridium chloride, potassium chloroiridate, ammonium hexachloroiridate, ammonium hexachlorophatinate and potassium hexachloroplatinate.

3. a silver halide photographic emulsion according to claim 1 wherein the amount of at least one of said sensitizing dyes is from 3 to 500 mg per mole of silver halide.

4. A silver halide photographic emulsion according to claim 1 wherein the emulsion comprises silver halide grains of less than 3μ in an average diameter.

5. A silver halide photographic emulsion according to claim 1 wherein the emulsion further comprises a compound selected from the following:

(I)

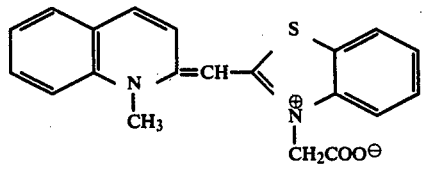

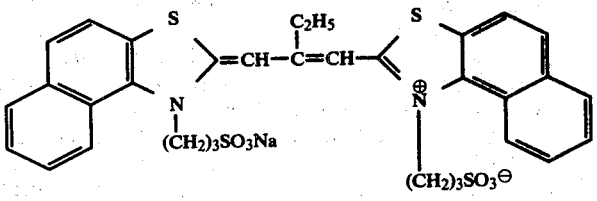

-continued
(II)
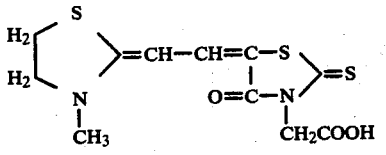
(III)
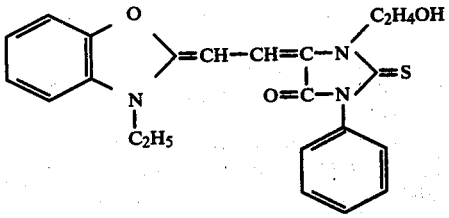
(IV)
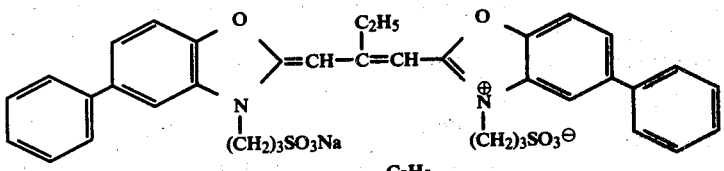
(V)
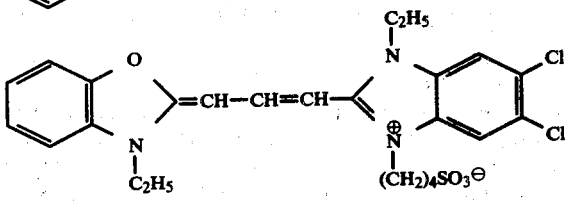
(VI)
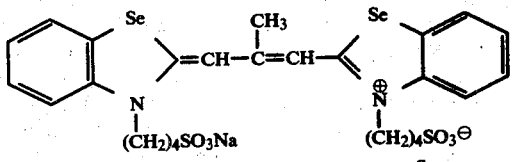
(VII)